United States Patent [19]

Böhme et al.

[11] Patent Number: 4,785,231

[45] Date of Patent: Nov. 15, 1988

[54] REFERENCE CURRENT SOURCE

[75] Inventors: Rolf Böhme, Bad Friedrichshall; Jürgen Sieber, Heilbronn, both of Fed. Rep. of Germany

[73] Assignee: Telefunken Electronic GmbH, Heilbronn, Fed. Rep. of Germany

[21] Appl. No.: 29,908

[22] Filed: Mar. 25, 1987

[30] Foreign Application Priority Data

Mar. 26, 1986 [DE] Fed. Rep. of Germany ..... 3610158

[51] Int. Cl.[4] ..... G05F 3/20

[52] U.S. Cl. ..... 323/316; 323/315

[58] Field of Search ..... 323/312, 315–317

[56] References Cited

U.S. PATENT DOCUMENTS

| | | | |
|---|---|---|---|
| 4,059,793 | 11/1977 | Ahmed . | |
| 4,091,321 | 5/1978 | Hanna . | |
| 4,350,904 | 9/1982 | Cordell | 323/315 X |
| 4,446,419 | 5/1984 | van de Plassche et al. | 323/316 |
| 4,587,478 | 5/1986 | Kasperkovitz et al. | 323/316 |
| 4,629,973 | 12/1986 | Voorman | 323/316 |

*Primary Examiner*—Patrick R. Salce
*Assistant Examiner*—Marc S. Hoff
*Attorney, Agent, or Firm*—Spencer & Frank

[57] ABSTRACT

At a reference current source with two transistors and a controlled double current source, the base of the second transistor is connected to the collector of the first transistor, the emitter of the first transistor is connected to a reference point, the first terminal of the controlled double current source is connected to the first transistor, and the second terminal of the controlled double current source is connected to the collector of the second transistor. Either a first resistor is inserted between the base and the collector of the first transistor, and the emitter of the second transistor is connected to the reference point or the first resistor is inserted between the emitter of the second transistor and the reference point, and the base and the collector of the first transistor are connected to one another. A resistor is connected between the base of the first transistor and the reference point and/or a resistor is connected between the collector of the second transistor and the reference point.

15 Claims, 3 Drawing Sheets

PRIOR ART

REFERENCE CURRENT SOURCE

BACKGROUND OF THE INVENTION

While much attention has been given to the stabilization of voltages, less regard has hitherto been paid to the stabilization of currents In a number of applications it is, however, primarily a stable current that is required, for example, when the supply is from current sources within a bipolar integrated circuit and with certain types of digital-to-analog and analog-to-digital converters. It is, in fact, possible to derive stable currents from a reference voltage source, but this always involves additional expenditure and a loss of accuracy. From a technical standpoint, the interest in means and methods for stabilizing currents is, therefore, considerable.

Band gap stabilization which goes back to R. J. Widlar (IEEE Journal of Solid-State Circuits, Volume SC-6, No. 1, 1971) relates to voltage stabilization. The parameters it attains are more or less as good as those of the Zener diode stabilization which had been predominantly used until then, smaller supply voltages are adequate, and it can be advantageously employed within a bipolar semiconductor circuit. The core of the circuit consists of two transistors whose current, densities are kept at a certain ratio by a skillful circuitry adjustment. The resulting difference in the voltage of the base-emitter diodes is proportional to the absolute temperature and is fed to a resistor arranged at the emitter of the transistor with the smaller current density, with the result that the current intake of the two transistors is proportional to the absolute temperature. U.S. Pat. No. 4,059,793 discloses that this resistor may also be advantageously arranged between base and collector of the transistor with the higher current density. J. E. Hanna indicates in U.S. Pat. No. 4,091,321 that a current with a freely settable temperature coefficient can be generated within this basic arrangement. This is achieved by a resistor being connected in parallel with a transistor of the band gap circuit which carries a current proportional to the absolute temperature. The current intake of this resistor is proportional to the base-emitter voltage which has a negative temperature coefficient. The sum of the two currents, therefore, consists of a temperature-dependently rising and a dropping current. Independency of temperature can be achieved by weighting. Since the aforementioned Patent deals with the generation of temperature-stable voltages no indication is given as to how to exploit this effect to produce temperature-stable current sources.

SUMMARY OF THE INVENTION

The object underlying the invention is to provide a circuit suitable for bipolar integration for one or several output currents which is/are as stable as possible and is/are dependent on neither the temperature nor the supply voltage which may cover a large range, but small supply voltage values should also be permissible.

In accordance with the invention, in a reference current source with two transistors and a controlled double current source, wherein the base of the second transistor is connected to the collector of the first transistor, the emitter of the first transistor is connected to a reference point, the first terminal of the controlled double current source is connected to the base of the first transistor and the second terminal of the controlled double current source is connected to the collector of the second transistor, and either a first resistor is inserted between the base and the collector of the first transistor, and the emitter of the second transistor is connected to the reference point or the first resistor is inserted between the emitter of the second transistor and the reference point, and the base and the collector of the first transistor are connected to one another, a resistor is connected between the base of the first transistor and the reference point and/or a resistor is connected between the collector of the second transistor and the reference point.

BRIEF DESCRIPTION OF THE DRAWINGS

The invention will now be described in greater detail, by way of examples, with reference to the drawings, in which.

DESCRIPTION OF THE PREFERRED EMBODIMENTS

Figure 1A:
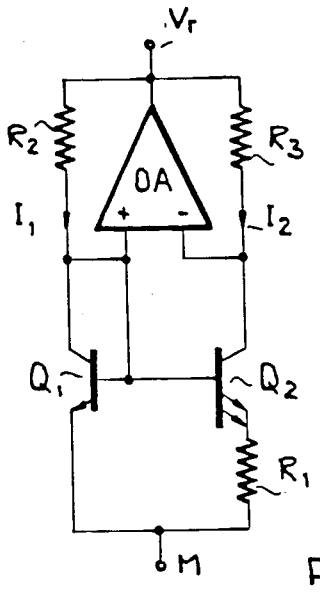
FIG.1a PRIOR ART
FIGS. 1*a* and 1*b* shows known forms of the voltage stabilization.
Figure 1B:
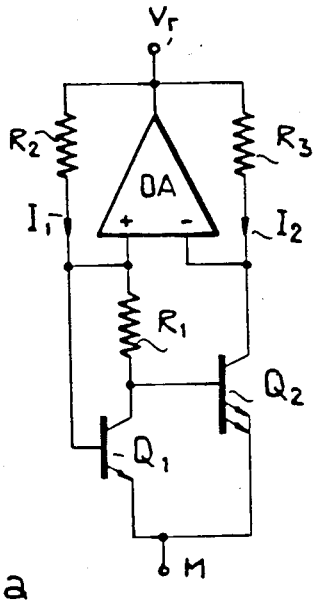

The known band gap voltage stabilization is illustrated in the basic form in FIGS. 1*a* and 1*b*. FIG. 1*a* shows the first form of the stabilization which is founded on the above-mentioned Widlar publication. The second form originates from the Ahmed U.S. patent which was also mentioned hereinabove. It is less dependent on component fluctuations and has a higher internal amplification.

The mode of operation of this circuit, which is known per se, is such that the two transistors are fed via resistors R2, R3 currents I1, I2 which are inversely related to these resistors: $I2/I1=R2/R3$. A certain ratio of the current densities of the emitter-base junction of transistors Q1, Q2 is fixed by this current ratio and also by the ratio of the emitter-base area of the two transistors. In the circuits of FIGS. 1*a* and 1*b*, it is assumed that the second transistor Q2 has the smaller current density. Its base-emitter voltage is, therefore, smaller. The voltage difference becomes effective in both variants as a voltage drop across resistor R1. Since, as the description of the bipolar transistor shows, the voltage difference is proportional to the absolute temperature, the current through R1 likewise becomes proportional to the absolute temperature. In the circuit of FIG. 1*a* the current through R1 is, furthermore, almost identical with current I2, in the circuit of FIG. 1*b* with current I1. The voltage drop across resistors R2, R3, therefore, likewise becomes proportional to the absolute temperature. The compensation effect with respect to the generated voltage Vr consists in that the voltage drop across R2 increasing with the temperature is added to the voltage drop across the emitter-base diode of the first transistor Q1 decreasing with the temperature.

Figure 2:
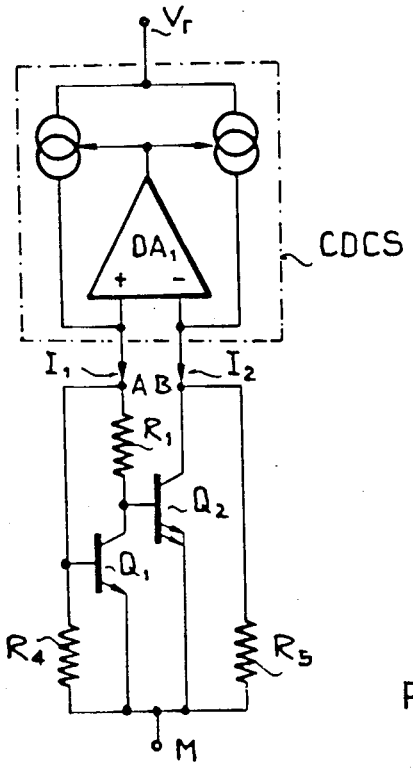
FIG. 2 shows the basic principle of the current stabilization.

To obtain a current which is independent of the temperature, provision is made in FIG. 2 for one decreasing current to be added to each of the currents flowing through transistor Q1 and transistor Q2 which increase with the temperature. In accordance with the invention, this is done by connecting resistors R4, R5 in parallel since, as stated hereinabove, the voltage drop across the transistor exhibits a negative temperature variation. By suitable choice of these resistors, the temperature coefficient of currents I1, I2 in FIG. 2 can be brought to zero. It has been shown that the ratio of the currents flowing in transistors Q1, Q2 need not be taken into consideration in the choice of the resistors. It is, therefore, not necessary for the current flowing through resistor R4 to bear the same ratio to the current through resistor R5 as the current flowing through transistor Q1 to the current through Q2. More particularly, it is possible to omit one of resistors R4, R5 and yet to set the point of the temperature independency of currents I1, I2. This fact simplifies the configuration of the amplifier circuit particularly with respect to the starting behavior.

The circuits shown in FIGS. 1*a* and 1*b*, each with differential amplifiers OA and resistors R2, R3, relate to the generation of temperature-stable voltages. The configuration of the amplifier circuit is irrelevant in achieving temperature compensation of the current. What is essential is merely that the ratio of the two currents I1, I2 be maintained, independently of their size, and that the voltage difference between the base of transistor Q1 and collector of transistor Q2 approach zero. Accordingly, $I1=Rt1 \cdot Uab$ and $I2=Rt2 \cdot Uab$, should apply, with Uab being the voltage between junctions A and B in the circuit of FIG. 2 and Rt1 and Rt2 being transfer resistances which should have as high a value as possible but bear a fixed ratio to each other. This model conception is referred to as "controlled double current source".

Figure 3:
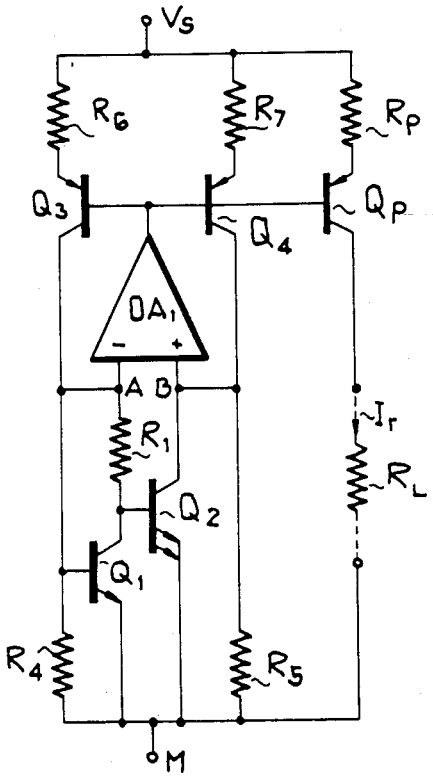
FIG. 3 shows the configuration of the controlled current sources.

A preferred embodiment of the controlled double current source is shown in FIG. 3. It consists of a differential amplifier OA1 whose input is connected to the junctions A, B and two transistors Q3, Q4 of complementary conductivity with respect to transistors Q1, Q2. The bases of transistors Q3, Q4 are connected to the output of the differential amplifier OA1. The emitters of transistors Q3, Q4 are connected, if appropriate, via resistors R6, R7 to a supply voltage Vs. The collector of transistor Q3 is connected to junction A and the collector of transistor Q4 to junction B. If the input currents of the differential amplifier OA1 can be neglected, the collector currents of transistors Q3, Q4 are identical with the currents I1, I2 of FIG. 2. The ratio of currents I1, I2 is fixed by the configuration of transistors Q3, Q4. The effect of tolerances and also the noise contribution of transistors Q3, Q4 can be reduced by additionally inserted emitter resistors R6, R7. FIG. 3 shows a further transistor Qp whose base is likewise connected to the output of the differential amplifier OA1 and whose emitter is likewise connected, if appropriate, via an emitter resistor Rp, to the supply voltage Vs. It adds to the controlled double current source a third output which carries the same or proportional output current Ir and is used in a consumer symbolically illustrated as load resistor $R_L$.

Figure 4:
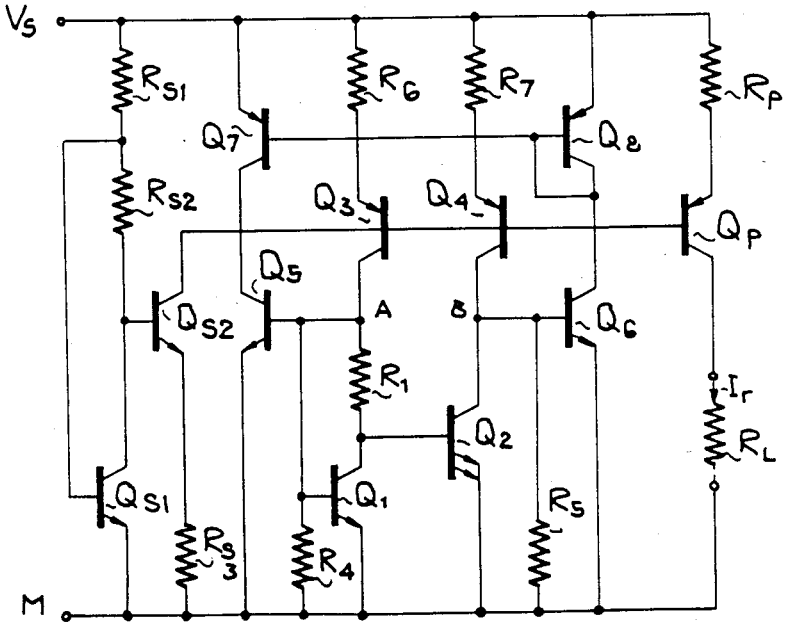
FIG. 4 shows a first amplifier arrangement.

FIG. 4 shows a first embodiment of the differential amplifier OA1 introduced in FIG. 3. It consists of the differential amplifier with transistors Q5, Q6 whose bases are connected to junctions A, B and whose emitters are connected to the reference point. A resistor can also be inserted between the emitters and the reference point to influence the operating currents or reduce a common mode influence. The differential stage operates onto a current mirror comprising transistors Q7 and Q8 which are complementary with transistors Q5 and Q6 and whose emitters are connected to the supply voltage. The collector of transistor Q6 is connected to the collector and base of transistor Q8 and to the base of transistor Q7, and the connection of the collectors of transistors Q5 and Q7 constitutes the output of the differential amplifier OA1.

The circuit of FIG. 4 also exhibits the previously mentioned starting problem if there is no special starting circuit with transistors Qs1 and Qs2 and resistors Rs1, Rs2, Rs3. Since junctions A and B are connected via resistors R4, R5 to the reference point, the base of transistors Q1, Q2 remains at zero potential and the circuit remains currentless even after the supply voltage has been switched on. If, however, resistor R4 is removed, an initial potential which leads to a first current in transistor Q5 can be built up by residual currents at junction A. This current returns with a multiple value due to the current amplification of transistor Q3 to junction A and leads to avalanche-type increase of the total current until the current of transistor Q2 is choked as a result of an increasing voltage drop at resistor R1, the potential at junction B rises, transistor Q6 starts to carry current and prevents further current increase via the current mirror Q8, Q7, whereupon the circuit has entered the desired operating point. The possibility of effecting the temperature compensation one-sidedly with resistor R5 is, therefore, decisive for this kind of start.

Figure 5:
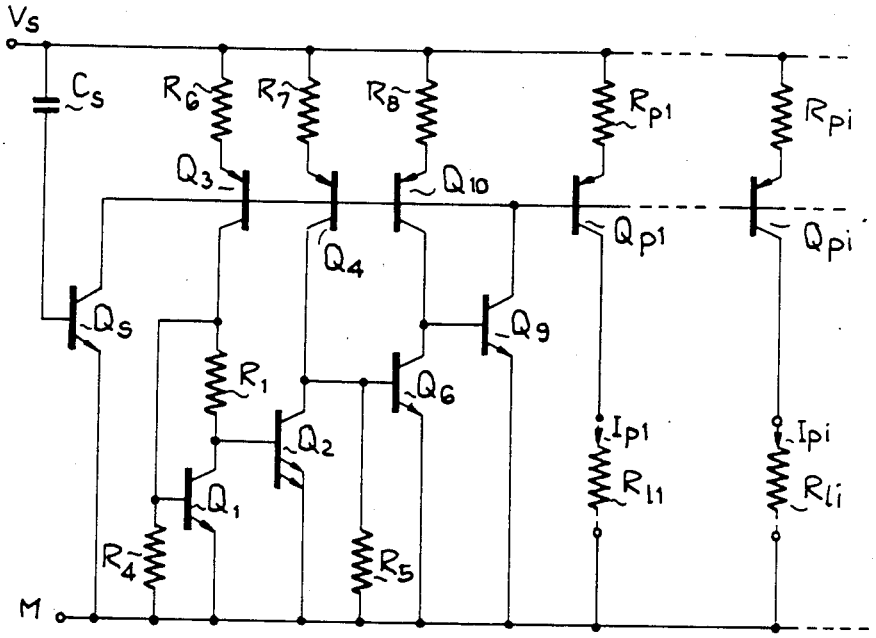
FIG. 5 shows a second amplifier arrangement with pnp current sources.

A substantially different configuration of the differential amplifier OA1 is illustrated in FIG. 5 where the potential of junctions A, B is not fed directly to a differential input. In this case, the mode of operation is such that the same operating point is imposed upon transistor Q6 connected to junction B as upon transistor Q1 so that the potentials of junctions A and B must also become identical with each other. For this purpose, the current source is provided with transistor Q10 whose base is connected to the base of the remaining current source transistors Q3, Q4 and whose emitter is connected to the supply voltage Vs as in the case of the current source transistors. Transistor Q10 determines the current in transistor Q6 via the connection of the collectors of transistors Q6, Q10. The amplification transistor Q9 which is connected downstream constitutes the output of the amplifier and controls the current source transistor bases which are connected to each other. This configuration requires only three transistors for the amplifier OA1. Provision of a larger number of transistors Qp1 . . . Qpi as output current sources is also possible without any disadvantages since the high loop gain via transistors Q6, Q9 permits a greater load. Transistors Q9 and Q10 constitute an effective starting circuit of this circuitry so that both compensation resistors R4, R5 may be connected.

Figure 6:
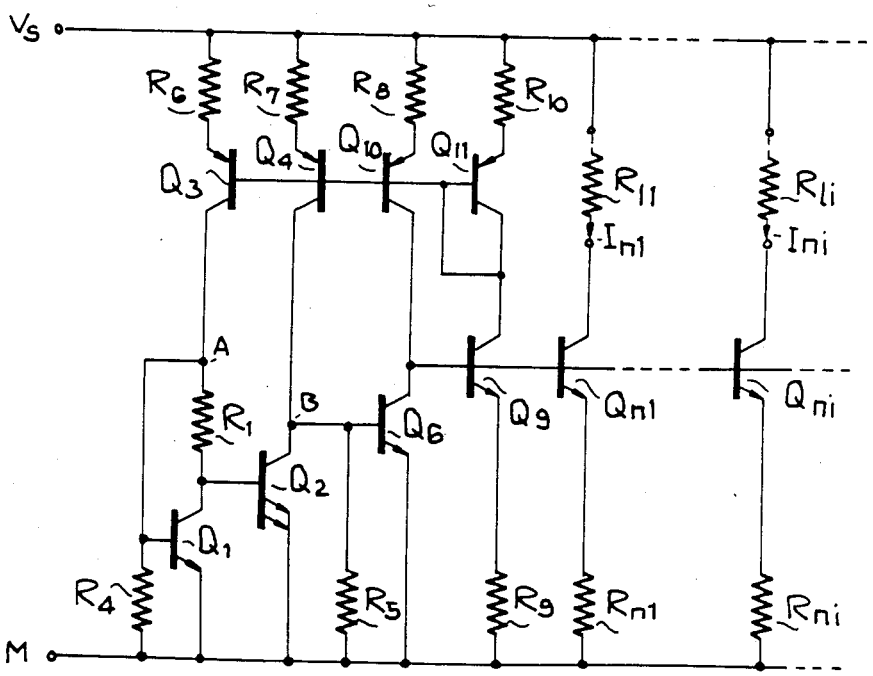
FIG. 6 shows an arrangement with npn current sources.

Finally, FIG. 6 shows a configuration wherein the current source transistors Qn1 . . . Qni are of the same conductivity type as transistors Q1, Q2 of the internal band gap cell. It is identical with the circuit of FIG. 5, with the exception of a transistor Q11 connected as diode which is connected in parallel with the base-emitter section of the remaining transistor current sources with a corresponding emitter resistor R10. The current intake of the diode transistor is, consequently, identical with or proportional to the remaining current sources. This current must be supplied together with the base currents of the current source transistors from transistor Q9. The stabilizing effect, therefore, also extends to the current through transistor Q9. Further transistors Qn1 . . . Qni arranged in the same way as transistor Q9 serve as stabilized output current sources. For the previously mentioned reasons, inserted emitter resistors R9, Rn1 . . . Rni are normally expedient.

Means for ensuring reliable starting of the circuit are also shown in FIGS. 4 and 5. A starting aid which supplies a starting current which is only slightly dependent on the supply voltage Vs is shown in FIG. 4. It consists of two transistors Qs1, Qs2 and three resistors Rs1, Rs2, Rs3. The first transistor Qs1 constitutes with resistors Rs1 and Rs2 a simple voltage stabilization by the first resistor Rs1 being connected between supply voltage and base, and the second resistor Rs2 between base and collector of transistor Qs1. Resistor Rs2 is relatively small compared with Rs1 and it is of such configuration that the collector voltage of transistor Qs1 changes as little as possible in the supply voltage range provided. The second transistor Qs2 receives this stabilized collector voltage between base and emitter, and a further shearing resistor Rs3 may be connected in front of the emitter. The current developed by transistor Qs2 flows into the bases of the current source transistors Q3, Q4. The circuit enters the operating state if the current supplied by transistor Qs2 is large enough for the amplified current flowing in transistor Q3 to produce an adequate voltage drop across resistor R4 to make transistor Q5 conductive.

A further method to aid starting is illustrated in FIG. 5. A starting transistor Qs whose base is connected via a capacitor Cs to the supply voltage Vs, whose emitter is connected to the reference point and whose collector is connected to the bases of the current source transistors Q3, Q4 is provided. The mode of operation is such that the charging current surge on switching on the supply voltage, amplified by transistor Qs, is conducted to the bases of the current source transistors which thus initiate the flow of current in the circuit. After the capacitor Cs has been charged, Qs becomes currentless.

The steady-state firing circuit shown in FIG. 4 maintains the operating point of the stabilization circuit in all operating states, but requires an additional current. The dynamic firing circuit shown in FIG. 5 requires no operating current. If, however, for any reason, the current flow is interrupted while voltage is applied, the circuit remains in the off state.

In all of the circuits of FIGS. 3 to 6, no more than two transistor systems are galvanically connected in series, which means that if silicon transistors are used, approximately 1 V operating voltage is adequate for operability.

What is claimed is:

1. A reference current source, comprising: a controlled double current source, including a first terminal and a second terminal and means for producing a first current at said first terminal and a second current at said second terminal, the first and second currents being proportional to each other and proportional to a voltage across said first and second terminals;

a first transistor having its emitter connected to a reference point and its base connected to said first terminal;

a second transistor having its collector connected to said second terminal and its base connected to the collector of said first transistor;

first coupling means connecting the base of said first transistor to the collector of said first transistor, and second coupling means connecting the emitter of said second transistor to said reference point, one of said first coupling means and said second coupling means including a series connected resistor, and the other of said first coupling means and said second coupling means comprising a direct connection; and a second resistor connected between said reference point and one of the collector of said second transistor and the base of said first transistor.

2. A reference current source as in claim 1, further comprising a third resistor connected between said reference point and the other of the collector of said second transistor and the base of said first transistor.

3. A reference current source as defined in claim 1, wherein the second resistor is of such dimensions that the first and second currents are as independent as possible of the ambient temperature.

4. A reference current source as defined in claim 3, wherein for some ambient temperature range the temperature dependency of the first and second currents disappears in a neighborhood of at least one temperature in the ambient temperature range.

5. A reference current source as defined in claim 1, wherein said double current source comprises two current source transistors, which are of a complementary conductivity type with respect to the first and second transistors, whose emitters are each one of directly connected and connected via a resistor to a supply voltage and whose bases are connected to the output of an amplifier arrangement.

6. A reference current source as defined in claim 5, wherein the amplifier arrangement is a differential amplifier whose first input is connected to the base of the first transistor, and whose second input is connected to the collector of the second transistor.

7. A reference current source as defined in claim 5, wherein the amplifier arrangement comprises a differential stage having outputs and comprising two differential stage transistors which operate onto a current mirror having an input and an output and comprising two current mirror transistors of complementary conductivity, with the bases of the differential stage transistors each being one of directly connected and connected via a resistor to the reference point, the outputs of the differential stage being respectively connected to the input and the output of the current mirror and the output of the current mirror constituting the output of the amplifier arrangement.

8. A reference current source as defined in claim 5, wherein the amplifier arrangement comprises an input transistor whose base is connected to the collector of the second transistor and whose emitter is connected to the reference point.

9. A reference current source as defined in claim 8, wherein the collector of the input transistor is connected to the collector of another transistor connected as a current source, with the base of another transistor being connected to the bases of the current source transistors of the double current source and the emitter of another transistor being one of directly connected and connected via a resistor to the supply voltage.

10. A reference current source as defined in claim 8, wherein the base of an output transistor whose emitter is connected, if appropriate, via a resistor to the reference point and whose collector constitutes the output of the amplifier arrangement and is connected to the bases of the current source transistors, is connected to the collector of the input transistor.

11. A reference current source as defined in claim 5, wherein the bases of the current source transistors are connected via a transistor connected as a diode, one of directly and via a resistor to the supply voltage.

12. A reference current source as defined in claim 5, wherein at least one further transistor serving as an output current source is connected, with its bases being connected to the base of the current source transistors and its emitter being connected or via a resistor to a terminal of the supply voltage.

13. A reference current source as defined in claim 10, wherein at least one further transistor serving as output current source is connected, with its base being connected to the base of the output transistor and its emitter being one of directly connected and connected via a resistor to the reference point.

14. A reference current source as defined in claim 5, wherein the bases of the current source transistors are connected to the collector of a starting transistor whose emitter is connected to the reference point and whose base is connected via a capacitor to the supply voltage.

15. A reference current source as defined in claim 5, wherein the collector of a second starting transistor is connected to the bases of the current source transistors, the base of the second starting transistor is connected to the collector of a first starting transistor, a series resistor leads from the supply voltage to the base of the first starting transistor, a further resistor is connected to the base and to the collector of the first starting transistor, and the emitter of the first starting transistor is connected to the reference point and the emitter of the second starting transistor is one of directly connected and connected via a resistor likewise to the reference point.

* * * * *